United States Patent [19]

Siano

[11] Patent Number: 4,872,646

[45] Date of Patent: Oct. 10, 1989

[54] RAILROAD TIE REPLACEMENT APPARATUS

[76] Inventor: James C. Siano, P.O. Box 2061, Media, Pa. 19063

[21] Appl. No.: 252,033

[22] Filed: Sep. 28, 1988

Related U.S. Application Data

[63] Continuation of Ser. No. 74,443, Jul. 16, 1987, abandoned, which is a continuation-in-part of Ser. No. 893,660, Aug. 6, 1986, abandoned, which is a continuation of Ser. No. 798,885, Nov. 18, 1985, abandoned.

[51] Int. Cl.[4] ..... E01B 29/22

[52] U.S. Cl. ..... 254/43

[58] Field of Search ..... 254/43, 44; 104/9

[56] References Cited

U.S. PATENT DOCUMENTS

| | | | |
|---|---|---|---|
| 1,081,162 | 12/1913 | Smith | 254/43 |
| 1,431,710 | 10/1922 | Uno | 254/43 |
| 1,985,768 | 12/1934 | Drake | 254/43 |
| 2,133,851 | 10/1938 | Denton | 254/43 |

*Primary Examiner*—Robert C. Watson

[57] ABSTRACT

Apparatus for removing a railroad tie from under conventional railroad tracks and inserting a replacement tie into the vacated tie position, including a base insertable below a conventional railroad track on either side of a tie to be removed, a shaft transversely positioned and rotatably mounted on the base and spaced above the base, a cable residing on the shaft having a first end secured to the shaft and having a remaining end loose for converting rotation of the shaft tensile force along the direction of extension of the cable, a clamp connected to the base for releasably engaging the rail below the operating surface, a lever for rotating the shaft, a ratchet for connecting the lever with the shaft for shaft rotation in a first direction and allowing lever rotation in an opposite angular direction without the shaft rotating and an attachment device for attaching the cable to an end of the railroad tie to be removed from or inserted under the railroad track.

41 Claims, 10 Drawing Sheets

RAILROAD TIE REPLACEMENT APPARATUS

CROSS REFERENCE TO RELATED PATENT APPLICATION

This patent application is a continuation of application Ser. No. 074,443, filed July 16, 1987, now abandoned, which is a continuation-in-part of copending U.S. patent application Ser. No. 893, 660, filed Aug. 6, 1986, now abandoned, which in turn is a continuation of U.S. patent application Ser. No. 798,885, filed Nov. 18, 1985, now abandoned.

FIELD OF THE INVENTION

This invention relates to apparatus for removing and replacing worn, damaged or rotted railroad ties.

BACKGROUND OF THE INVENTION

Damaged or rotted railroad ties must be removed from and replaced in an existing rail bed. To replace such ties, the spikes holding the tie fixed with respect to its associated rails must be removed and any ballast, gravel or other debris in the vicinity of the tie must also be removed.

Conventionally, track is jacked up over the tie to create additional clearance to permit removal of the tie. Once the spikes have been removed, the ballast has been removed and the track has been jacked up, the tie is conventionally pulled by one or more track workers bending over and manually extracting the tie by pulling it along its longitudinal direction, transversely to the rails.

Various mechanized approaches have been suggested for removing railroad ties but heretofore none have any significant degree of acceptance, much less commercial success. Typical of the mechanized approaches are those shown in U.S. Pat. Nos. 1,247,224 and 4,343,457 which disclose rail jack apparatus designed to apply some mechanical advantage to a tie being removed from a rail bed. The apparatus disclosed in these patents has not been adopted or used to any significant degree, let alone been commercially successful, in part because the apparatus necessitates that the track, from which the tie is being removed, be taken out of operation during the tie removal process. On busy roadbeds, this unacceptable.

Of the prior art known to applicant, of greatest relevance to the invention is U.S. Pat. No. 2,133,851 disclosing tie pulling apparatus which can be used to remove a tie while not presenting any obstruction to safe and normal passage of a train over the rails under which the tie is being removed and replaced. However, for a variety of reasons, the apparatus disclosed in '851 has not been accepted and track workers have continued to rely on manual methods, with associated obvious danger of disabling back injury. One probable reason that the '851 apparatus has not achieved any significant acceptance, let alone commercial success, in the railway maintenance field is that the '851 apparatus cannot be used to remove a worn, damaged or rotted tie and to insert a replacement tie without either moving the apparatus (with respect to the position into which the tie is to be inserted) while replacing the tie or interfering with tracks adjacent to the track undergoing repair.

Other reasons the '851 apparatus has not achieved commercial acceptance are that the apparatus is cumbersome to move and is difficult to place into and maintain in position and in engagement with the railroad track under which a tie is being replaced.

SUMMARY OF THE INVENTION

This invention provides apparatus for replacing railroad ties by removing a first railroad tie from position under conventional railroad tracks by moving the first tie transversely to the track and inserting a second, replacement tie into the vacated tie position by preferably moving the replacement tie in a direction opposite to the direction of removal of the first tie, while permitting train passage over the track while the apparatus is in place for tie removal and tie insertion. The invention is usable without changing the position of the apparatus with respect to the direction of train travel over the railroad tracks while removing a worn, damaged or rotted railroad tie and replacing it with a new tie. The apparatus facilities removal and replacement of ties of varying widths. The apparatus is not removed or repositioned with respect to the train track undergoing repair as the first tie is remove and replaced with a second tie. The apparatus preferably mounts flushly against the bottom of a rail and is retained in position, contacting the rail, during train travel over the track being repaired. The apparatus includes means for securing the apparatus to the track undergoing repair. One embodiment includes a camming member for converting generally angular motion to a substantial force urging the tie repair apparatus upwardly against the bottom surface of a rail portion of the railroad track undergoing repair.

The apparatus includes a pair of longitudinally elongated spaced apart support members adapted to be inserted, between a conventional railroad track rail and roadbed ballast beneath the rail, longitudinally with respect to the tie and transversely with respect to the rail, on either side of the first tie to be removed from under the rail and hence on either side of space vacated by the first tie into which the second tie is to be inserted, beneath the rail. Portions of upper surfaces of the support members are substantially flat and adapted to be positioned coplanarly with the lower surface of the base of the rail for flush facing contact therewith. The apparatus further includes a bridging member secured to the support members, fixedly positioning the support members spaced apart with respect to each other sufficiently far to permit the support member to be inserted beneath the rail on either side of the tie to be removed.

The apparatus still further includes transversely positioned, with respect to the ties, shaft means rotatably connected to the support members. Reel means connected to and rotatable with the shaft means collect and dispense flexible line means, in the longitudinal direction with respect to the tie, upon rotation of the shaft means. The flexible line means is housed on reel means with a first end secured to the reel means with the remaining end loose. Mounted on the support members are means for releasably engaging the rail below the operating surface thereof and for preventing relative movement of the apparatus with respect to the rail when those means engage the rail.

The apparatus further includes angularly movable lever means extending radially outwardly from the shaft, for rotating the shaft in response to angular movement of the lever with respect to the shaft upon the lever being connected with the shaft. First ratchet means connect the lever with the shaft for lever powered rotation of the shaft in a first rotational direction upon lever angular movement in a first direction with respect to the shaft and permit lever angular movement in a second direction, opposite to the first direction, without shaft rotation. Second ratchet means selectably engage the shaft and preclude shaft rotation in other than the first rotational direction. First and second means are provided for selectably engaging the first and second ratchet means with the shaft. The shaft is free-wheeling when the selectable ratchet engagement means are disengaged. The apparatus may also include tie clasping means for transmitting tensile force in the line means to an end of either the first or the second tie in a direction of longitudinal travel thereof during respective removal from or insertion into position under the railroad track, where the tie clasping means may be width-adjustable for facilitating clasping ties of different sizes.

In a preferred embodiment of the invention, adjustable extention members protrude from the base of the apparatus underneath the means on which the adjustable line means resides, where the extension members have portions adapted for abutting engagement with the rail, permitting the apparatus to be secured against curved track, track that is out-of-square or a rail bent as a result of wreckage and the like. These extension members have portions for gripping the rail, and float respecting the main portion of the apparatus thereby providing further stability to adapt to differently configured surfaces of the rail.

The apparatus still further preferably includes jaw means fitting the inside of the rail against the inside of the rail base, rotatably mounted on the base of the apparatus in addition to being slidable back and forth respecting the remainder of the curved or out-of-round or broken or bent rails and the like, permitting replacement of ties in such areas.

The apparatus further preferably includes low friction, preferably polymer materials providing a bearing surface at the portion of the apparatus contacted by a tie being removed or inserted into appropriate space beneath the apparatus track.

In a further preferred embodiment of the apparatus, handle means are provided having two portions each respectively engaging a winch or ratchet for rotating shaft portions of the apparatus.

As yet another feature of the invention, the entire base of the invention is preferably cast of a single piece of aluminum magnesium alloy having mounted thereon dual winches driven separately by the two separate portions of the handle portion, thereby effectively eliminating application of bending moments to the shafts on which the reels reside which take up the flexible line means when a tie is removed or inserted into the appropriate space beneath the rail.

Figure 1:
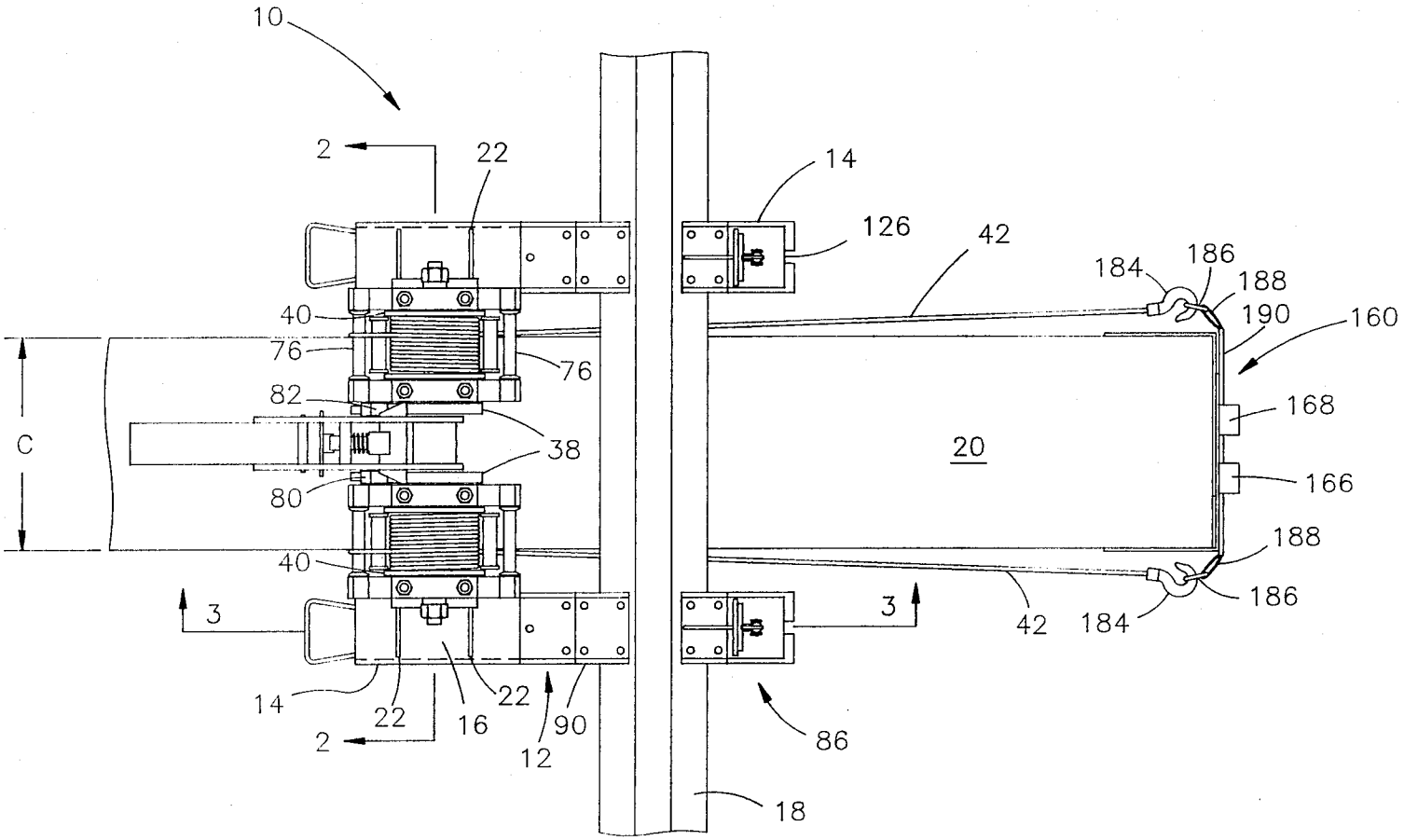
FIG. 1 is a top view of a first embodiment of apparatus, manifesting aspects of the invention, engaging a railroad track rail and applying force to a railroad track tie under the rail.

In the drawings, elements whose numbers have prime notations are functionally equivalent to elements, in other embodiments, having the same indicator numerals but lacking such prime notations.

DETAILED DESCRIPTION OF THE INVENTION AND BEST MODE CONTEMPLATED FOR PRACTICE THEREOF

Figure 2:
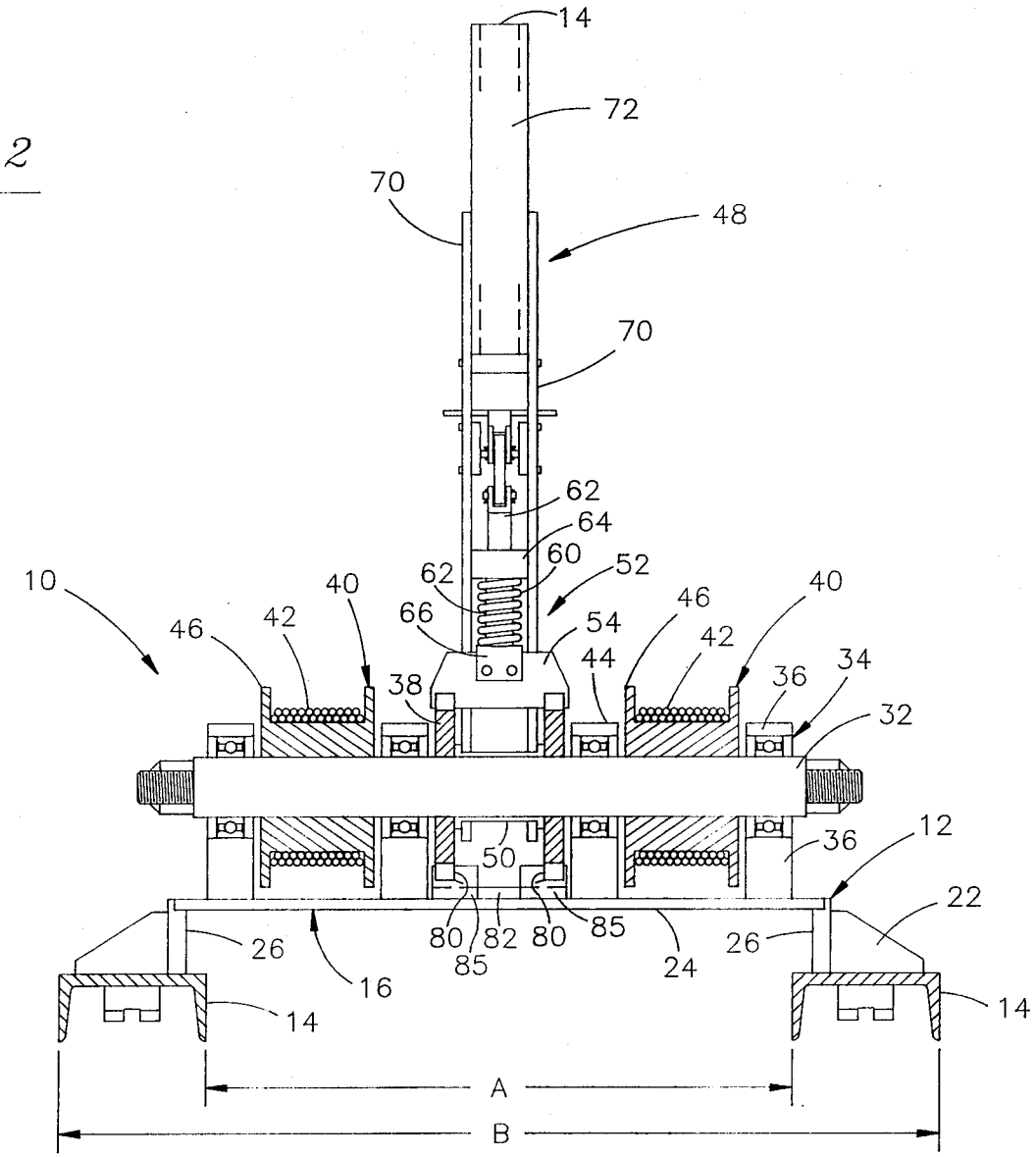
FIG. 2 is a front view, partially in section, of the apparatus illustrated in FIG. 1 with the section taken at 2—2 in FIG. 1.
Figure 3:
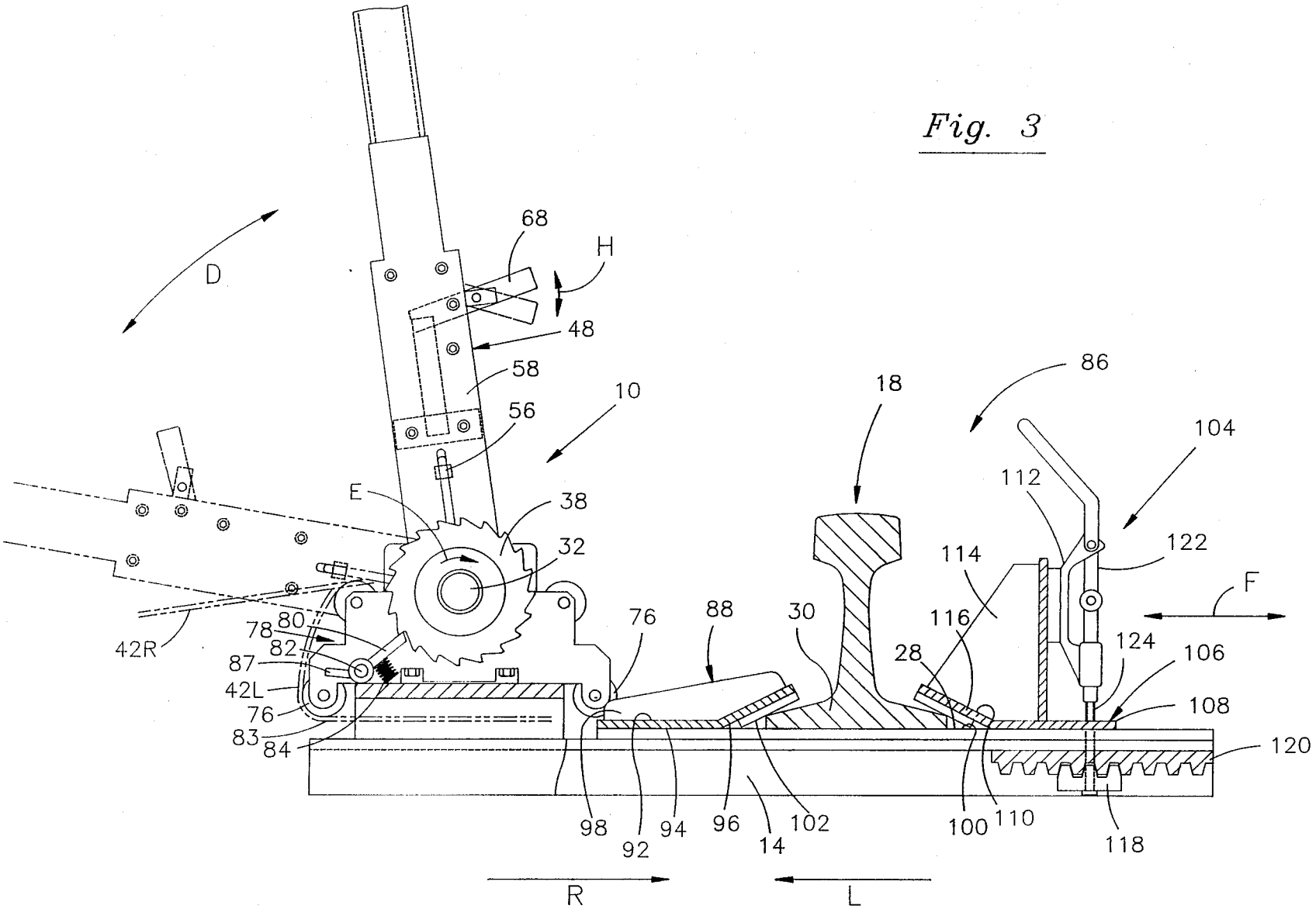
FIG. 3 is a side view, partially in section, of the apparatus illustrated in FIGS. 1 and 2 with the section taken at 3—3 in FIG. 1.

Referring to the drawings and to FIGS. 1, 2 and 3 in particular, a first embodiment of apparatus embodying aspects of the invention is designated generally 10 and, as can be best seen in FIGS. 1 and 2, includes a base designated generally 12. Base 12 includes a pair of longitudinally elongated spaced apart support members 14 which may be in the form of heavy aluminum channels having a generally U-shaped cross-section as illustrated in FIG. 2.

Base 12 further includes a bridging member 16 fixedly secured to support members or legs 14, positioning support members 14 spaced apart with respect to each other a distance sufficient to permit support members 14 to be inserted beneath a rail 18, forming part of a conventional railroad track, on either side of a conventional tie or timber 20 to be removed from the railbed. Support members 14 are spaced apart a distance between their inner edges, where the distance is indicated by dimension A in FIG. 2, sufficient to permit insertion of the apparatus, specifically base 12, on either side of a tie 20 to be removed. Typically dimension A is about sixteen and one-half inches for railroad track having standard gauge of four feet, eight and one-half inches, as used in the U.S.A., and the ties are of standard width as used in the U.S. The width of such a conventional tie as used in the U.S. is indicated as dimension C in FIG. 1 and is typically from about six to eight inches. Support members 14 have width sufficiently small so that the outside edges of support members 14 are separated by a distance, indicated by dimension B in FIG. 2, less than the distance separating inside edges of railroad ties in a conventional railroad bed on either side of the tie or timber 20 which is to be removed and replaced. Typically the apparatus is constructed with dimension B about twenty-four and one-half inches.

Bridging member 16 is secured to support members 14 preferably via suitable welds not shown in the drawings. Reinforcing flanges 22 are provided for bracing bridging member 16 and support members 14, with reinforcing flanges 22 preferably being welded to support members 14 and bridging member 16 to provide additional structural rigidity. Reinforcing flanges 22 have surfaces, unnumbered in the drawings, which are generally flat and fit flush with support members 14 and bridging member 16 to provide maximum reinforcement. Reinforcing flanges 22 are also cut away on a diagonal, as illustrated in FIG. 2, to provide maximum strength with minimum weight.

Base 12 may be fabricated from a single member, such as a single casting. Also, support members 14 may be bolted to bridging member 16 or secured by other means, so long as adequate strength is provided. While an aluminum magnesium alloy is preferred for base 12, other materials of adequate strength may be used. The preferable configuration of bridging member 16 is with a planar portion 24 extending generally parallel with the railroad track rail and a pair of leg portions 26 abuttingly contacting support members 14 and reinforcing flanges 22. Once welded together, base 12 (including support members 14), bridging member 16 (consisting of planar portion 24 and leg portions 26) and reinforcing flanges 22 provide a strong yet lightweight base for the apparatus with legs 26 elevating planar portion 24 of bridging member 16 above support members 14.

Support members 14 are longitudinally elongated and positioned with their longitudinal axes transverse to the operating rail 18, as illustrated generally in FIGS. 1 and 3. Each support member 14 has at least a portion of its substantially flat upper surface 28 adapted to be positioned coplanar with the lower surface of the base 30 of rail 18, for flush facing contact, as illustrated best in FIG. 3. Upper flat surface 28 of support member 14 extends some distance along the longitudinal length thereof, to facilitate flush facing contact with bases of rails of various sizes.

A rotatable shaft 32 is mounted on and spaced above bridging member 16. Shaft 32 is journaled in bearings 34 housed in legs 36 extending upwardly from base 16. Legs 36 are secured to base 16 via welds or bolts, not illustrated in the drawings.

Shaft 32 may be a solid shaft or may be a turned and polished piece of threaded stock; construction of shaft 32 is not critical so long as the shaft is sufficiently strong to resist substantial bending when forces are applied thereto in the course of removing or inserting a railroad tie into the railbed. Preferably at least four legs 36, with associated bearings 34, are provided to house shaft 32 and to provide support for shaft 32 when load is applied. Shaft 32 is positioned on bridging member 16 to be generally parallel with rail 18, when the apparatus is in the railbed, and hence to be generally transverse to tie or timber 20. Shaft 32 is freewheeling due to the rotatable connection provided between shaft 32 and legs 36 by bearings 34.

Mounted on shaft 32 for unitary rotation therewith are a pair of gears 38 having their gear teeth cut in ratchet shape, with one side of each tooth defined by a straight line extending radially outwardly from the center of ratchet gear 38 and the second side of each tooth being curved like a spur gear. Ratchet gears 38 are positioned on shaft 32 to rotate shaft 32 in the clockwise direction as viewed in FIG. 3.

Fixed on and rotatable with shaft 32 are a pair of reels 40 functioning to selectably collect or dispense a flexible line, in the form of a cable, upon rotation of shaft 32. Cable 42 resides on reel 40 and has a first end secured to reel 40 with a remaining end generally loose for connection to tie 20 to apply tensile force thereto. Two reels 40, each with a cable 42, are preferably provided equally spaced on either side of ratchet gears 38 as illustrated in FIG. 1. Each reel 40 includes a central interior spool portion 44 and a pair of radially outwardly extending lips 46, best shown in FIG. 2, which retain the remaining portion of cable 42 on central spool 44 of reel 40 as cable is drawn off of or fed onto reel 40 due to rotation of shaft 32. The manner in which reels 40 are secured to shaft 32 is not critical so long as adequate strength is provided.

A lever assembly designated generally 48 extends generally radially outwardly from shaft 32 to rotate shaft 32 in response to angular movement of the lever with respect to the shaft when the lever engages the shaft. Lever 48 connects to a collar 50 slidably mounted on and rotatable independently on shaft 32.

Housed within lever assembly 48 is a spring loaded driving plate assembly designated generally 52 including a driving plate 54 protruding laterally out of slots 56 in the body of lever assembly 48. Slots 56 are elongated along the longitudinal length of lever assembly 48 as illustrated in FIG. 3. Driving plate 54 can move within slots 56 from a position at which driving plate 54 engage ratchet gears 38, as illustrated in FIG. 3, to a position at which driving plate 54 is removed from ratchet gears 38, occupies the ends of slots 56 (which are illustrated as unoccupied in FIG. 3) and is disengaged from ratchet gears 38, thereby permitting lever 58 to be moved back and forth in the direction D in FIG. 3 without rotating shaft 32. Lever assembly 48 is generally movable angularly with respect to shaft 32 between the positions illustrated in FIG. 3.

A spring 60 coiled around a connecting member 62 and compressed between an abutment block 64 and a connecting plate portion 66 of driving plate 54 urges driving plate 54 downwardly, as viewed in FIGS. 2 and 3, into engagement with ratchet gears 38. Connecting member 62 passes slidably through abutment block 64 to facilitate disengagement of driving plate 54 from ratchet gears 38 upon suitable rotation of handle means 68 which protrudes generally transversely outwardly from lever assembly 48.

Lever assembly 48 further generally includes a pair of spaced apart, parallel plate members 70 within which the mechanism for disengaging driving plate 54 from ratchet gears 38 is generally housed. Secured between plates 70 and extending radially outwardly therefrom, away from shaft 32, is a sleeve 72 secured to plates 70. Sleeve 72 may be bored or may be hollow at its end 74 remote from shaft 32 to receive any extension shaft member used by track workers to provide additional mechanical advantage in applying rotary force to shaft 32 via lever assembly 48.

As best seen in FIG. 1, legs 36 not only serve to support shaft 32 but also provide means for mounting spools or spacers, which may be individually and independently rotatable, typical ones of which are indicated as 76 in FIG. 1. These spools or spacers facilitate orderly feeding of cables 42 on to and off of reels 40 by guiding cable 42 as it is dispensed or retrieved.

Spacers 76 are on either side of the axis of shaft 38 as illustrated in FIG. 3 and facilitate feeding or retrieving cable 42 onto and off of reels 40, in either longitudinal direction with respect to the tie or timber being removed or inserted. During operation shaft 32 preferably rotates only in the direction indicated by arrow E in FIG. 3. Ties or timbers 20 may be fed in either longitudinal direction with the apparatus operator selecting the direction of feed by drawing cables 42 off of reel 40 from either above or below the axis of rotation of shaft 32. As presented in FIG. 3, cable 42 comes off of reels 40 towards the left-hand side in FIG. 1, and may go around spacers 76, underneath reels 40 and extend to the right-hand side of FIG. 3 as indicated by 42L, to urge tie or timber 20 to the left in FIG. 3. If tie or timber 20 is to be moved in the opposite direction, cable 42 may be positioned as indicated by 42R. The direction of tie or timber movement may be altered by positioning cable 42 to come off of reel 40 below the axis of rotation of shaft 32; however, the arrangements shown in FIG. 3 are preferred.

Spring loaded driving plate assembly 52 generally provides a first ratchet means for selectably connecting lever assembly 48 with shaft 32 via ratchet gears 38, for rotation of shaft 32 in the direction indicated by arrow E upon lever angular movement in a corresponding direction, and permits lever angular movement in a second, opposite angular direction, without shaft rotation resulting.

A second ratchet means is designated generally 78 in FIG. 3 and serves to selectably engage shaft 38 for precluding rotation of shaft 38 in other than the direction indicated by arrow E. Second ratchet means 78 includes a ratchet plate 80 pivotally mounted about a hinge pin 82 and urged into position against the teeth of ratchet gears 38 by appropriate resilient spring means 84. Spring means 84 is disengageable from ratchet plate 80 and, when so-disengaged, permits ratchet plate 80 to pivot about hinge pin 82, thereby disengaging ratchet plate 80 from ratchet gears 38 and permitting shaft 32 to rotate in a direction opposite to that indicated by arrow E in FIG. 3.

Spring means 84 serves as means for selectably engaging the second ratchet means with shaft 32 while spring 60 and the mechanism associated therewith serve as means for selectably engaging the first ratchet means, defined generally by spring loaded driving plate assembly 52, with shaft 32 via ratchet gears 38. Shaft 32 is freewheeling when these respective ratchet engagement means are disengaged.

Mounted on support members 14 are means for releasably engaging rail 18 below the operating surface thereof and for preventing relative movement of apparatus 10 with respect to rail 18, with such means being designated generally 86 in FIGS. 1 and 3. This releasable engagement means is preferably provided in duplicate on each of spaced apart support members 14 with each releasable engagement means including a pair of jaw members mounted on a support member 14. The jaw members include a first jaw member designated generally 88 in FIG. 3 fixedly secured to support member 14, preferably by bolts shown as 90 in FIG. 1. First jaw member 88 includes a plate member 92 having a generally flat first portion effectively abutting a flat upper surface 28 of support member 14. Plate member 92 further includes an angled upwardly extending portion 96 bent away from support member 14, accommodating base 30 of rail 18 between angled portion 96 and support member 14. A reinforcing web 98 provides structural rigidity of first jaw member 88 and precludes flexure of angled portion 96 with respect to flat portion 94.

A flat sheet of electrically insulating material 100, preferably nylon, overlies the flat upper surface 28 of member 14 and provides an insulated flat upper surface of support member 14. A corresponding piece of electrically insulating material 102, also preferably nylon, is secured to the lower surface of angle portion 96 of plate member 92 so that rail 18 may be electrically insulated from apparatus 10 during removal of tie or timber 20.

Releasable engagement means 86 further include a second jaw member 104 movable longitudinally along support member 14 in the direction indicated by arrow F in FIG. 3. Second jaw member 104, similarly to first jaw member 88, includes a plate member 106 having a flat portion 108 and an angled portion 110. Second jaw member 104 further includes an upstanding post 112 and a reinforcing web 114 providing a high degree of structural rigidity for second jaw member 104 and preventing flexure of angled portion 110 with respect to flat portion 108 of plate member 106. Further similarly to first jaw member 88, second jaw member 104 includes a piece of electrically insulating material 116, preferably nylon, secured to the lower surface of angled portion 110, to insulate rail 18 from second jaw member 104.

Each second jaw member 104 further includes a rack member 118 longitudinally movable with respect to support member 14 on which the second jaw member moves and adapted to meshingly engage a rack member 120 affixed to the bottom of support member 14.

Second jaw member 104 further includes means for releasably securing second jaw member 104 at a selected position along support member 14 at which the rail is securely gripped between the first and second jaws with such releasable securing means being designated generally 122 in FIG. 3. This securing means includes a shaft member 124 residing in a longitudinal slot formed in support member 14 and connecting rack 118 with the portion of second jaw member 104 resting on support member 14, as shown in FIG. 3.

The flat upper surface of support member 14 provided by the sheet of insulating material 100 defines a shaped surface portion of support member 14, adapted for complemental facing contact with a corresponding shaped surface portion of second jaw member 104 defined by the bottom surface portion 108. These shaped surface portions, being in complemental facing contact with one another, facilitate movement of second jaw member 104 towards and away from a first jaw member 88 along a support member 14, to grip bases 30 of rails 18 of varying size.

Figure 4:
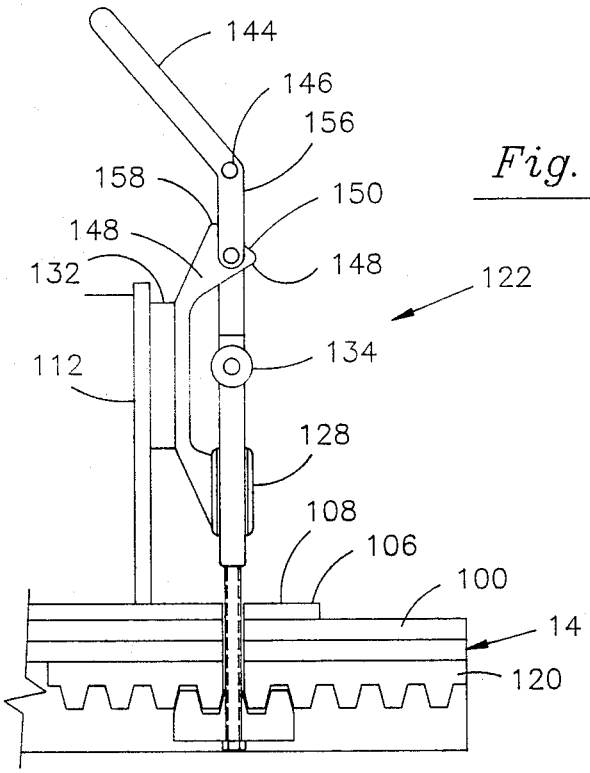
FIG. 4 is a detail of the extreme right-hand portion of the apparatus as viewed in FIG. 3.
Figure 6:
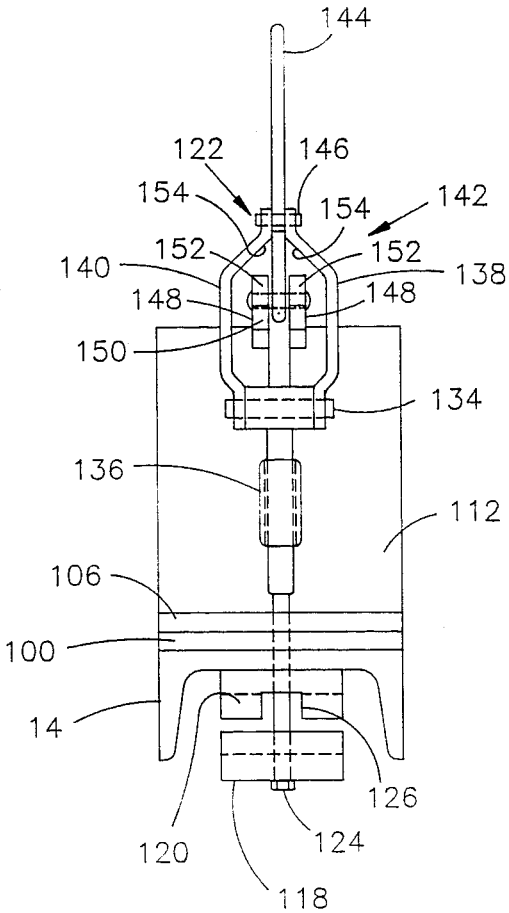
FIG. 6 is a right side elevational detail of the apparatus illustrated in FIGS. 4 and 5.
Figure 5:
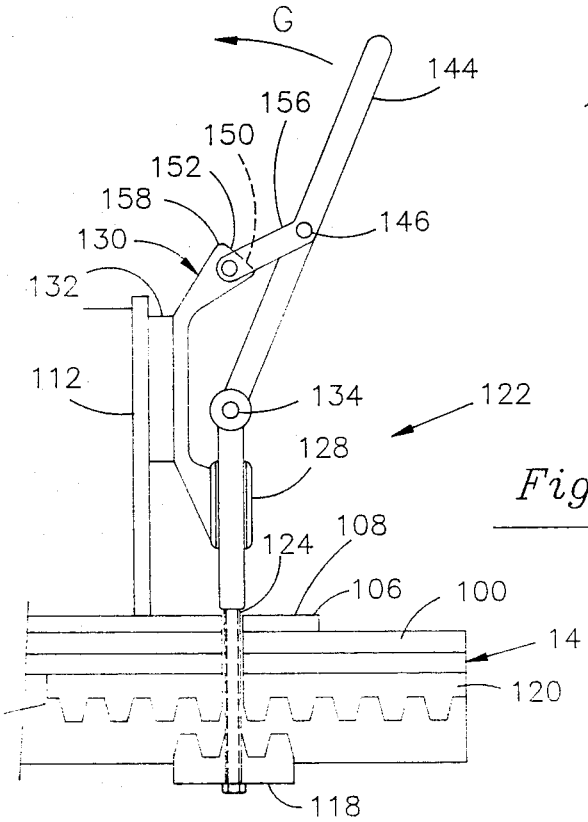
FIG. 5 is a detail taken at the same location and showing the same portion of the apparatus illustrated in FIG. 4, but in which the apparatus has been shown in an alternate operating position.

Jaw member securing means 122 is illustrated in greater detail in FIGS. 4, 5 and 6 and generally includes a bolt 124 threadedly engaging rack member 118 and extending upwardly through a space 126 which extends longitudinally within first rack 120, facilitating movement of second jaw member in a direction F in FIG. 3. Bolt 124 passes through a collar 128 secured to post 112 via frame 130; frame 130 is fixedly connected to pose 112 via a suitable connecting block 132. Bolt 124 is pivotally connected at its vertical extremity via pin 134 and sleeve 136 to respective legs 138, 140 of a cam follower designated generally 142. Cam follower 142 is pivotally connected to a bellcrank 144 via connecting pin 146. Bellcrank 144 is in turn pivotally connected between two extension portions 148 of frame 130 by a connecting pine 150, as illustrated in FIG. 6. Both extension portions 148 include a generally upwardly inclined camming surface 152 best seen in FIGS. 5 and 6. Camming surface 152 is contacted by respective inwardly facing cam follower surfaces 154 of legs 138, 140 of cam follower 142.

Bellcrank 144 is generally rotatably movable between the positions illustrated in FIGS. 4 and 5. When bellcrank 144 is moved by hand in the direction indicated by arrow G in FIG. 5 towards the position illustrated in FIG. 4, bellcrank 144 rotates about pin 150 thereby lifting cam follower 142 generally upwardly when considering FIGS. 4, 5 and 6, lifting bolt 124 and bringing respective teeth of rack member 118 into meshing engagement with corresponding spaces within rack 120. As bellcrank 144 is further rotated in the direction indicated by arrow G, bolt 124 and cam follower 142 defined by legs 138 and 140 become generally vertically aligned with each other and with a leg portion 156 of bellcrank 144. Leg portion 156 extends between pin 150 and pin 146. Consequently, these members become generally vertically aligned as illustrated in FIG. 4.

As these members move toward vertical alignment, cam follower surfaces 154 of respective legs 138, 140 encounter the upwardly inclined camming surfaces 152 formed on extension portions 148 of frame 130. As cam follower surfaces 154 move along camming surfaces 152, from right to left and from bottom to top as viewed in FIGS. 4 and 5 and from bottom to top in FIG. 6, vertically upward force of increasing magnitude is applied to rack 118 via cam follower 142 and bolt 124. As cam follower surfaces 154 reach the curved, vertical extremity 158 of camming surface 152 shown in FIGS. 4 and 5, cam follower 142 is retained in position by close fitting contact between cam follower surfaces 152 and curved vertical extremity 158 of camming surfaces 150, thereby retaining racks 118, 120 in meshing engagement and in turn resulting in rail 18 being tightly clamped between the first and second jaw members. This makes apparatus 10 immovable with respect to rail 18.

The particular dimensions of cam follower 142 and frame 130 are selected to provide the appropriate camming action and resultant required upward force applied via bolt 124 to rack member 118. When camming surface 152 and cam follower surface 154 are configured in the manner illustrated in the drawings, the apparatus is exceedingly easy to operate by hand with relatively small amounts of hand applied force to bellcrank 144 providing excellent, tight engagement of rack members 118, 120, precluding movement of apparatus 10 with respect to rail 18.

Second jaw member 104 and associated securing means designated generally 122 is movable in the direction F in FIG. 3 to accommodate rails of varying size. Slots 126 facilitate movement of second jaw members 140 and associated securing means 122 along support members 114.

Referring to FIG. 3, a lever assembly designated generally 48 is movable between the position shown in solid lines and the position shown in phantom lines, with rotation of lever assembly 48 resulting in rotation of ratchet gear 38. Furthermore, movement of handle 68 between the positions illustrated in FIG. 3, in the directions indicated by arrow H, moves driving plate 54 into and out of engagement with ratchet gears 38. When handle 68 is in the position illustrated in solid lines in FIG. 3, driving plate 54 engages ratchet gears 38 and is held in engagement therewith by spring force applied via spring 60. When handle 68 is moved to the position illustrated in phantom in FIG. 3, driving plate 54 is lifted upwardly, out of engagement with ratchet gears 38, against bias applied to driving plate 54 via spring 60. Handle 68, being pivotally movable, is connected to connecting member 62 via a connecting link and cotter pins which have not been numbered but are shown in FIG. 2.

Figure 7:
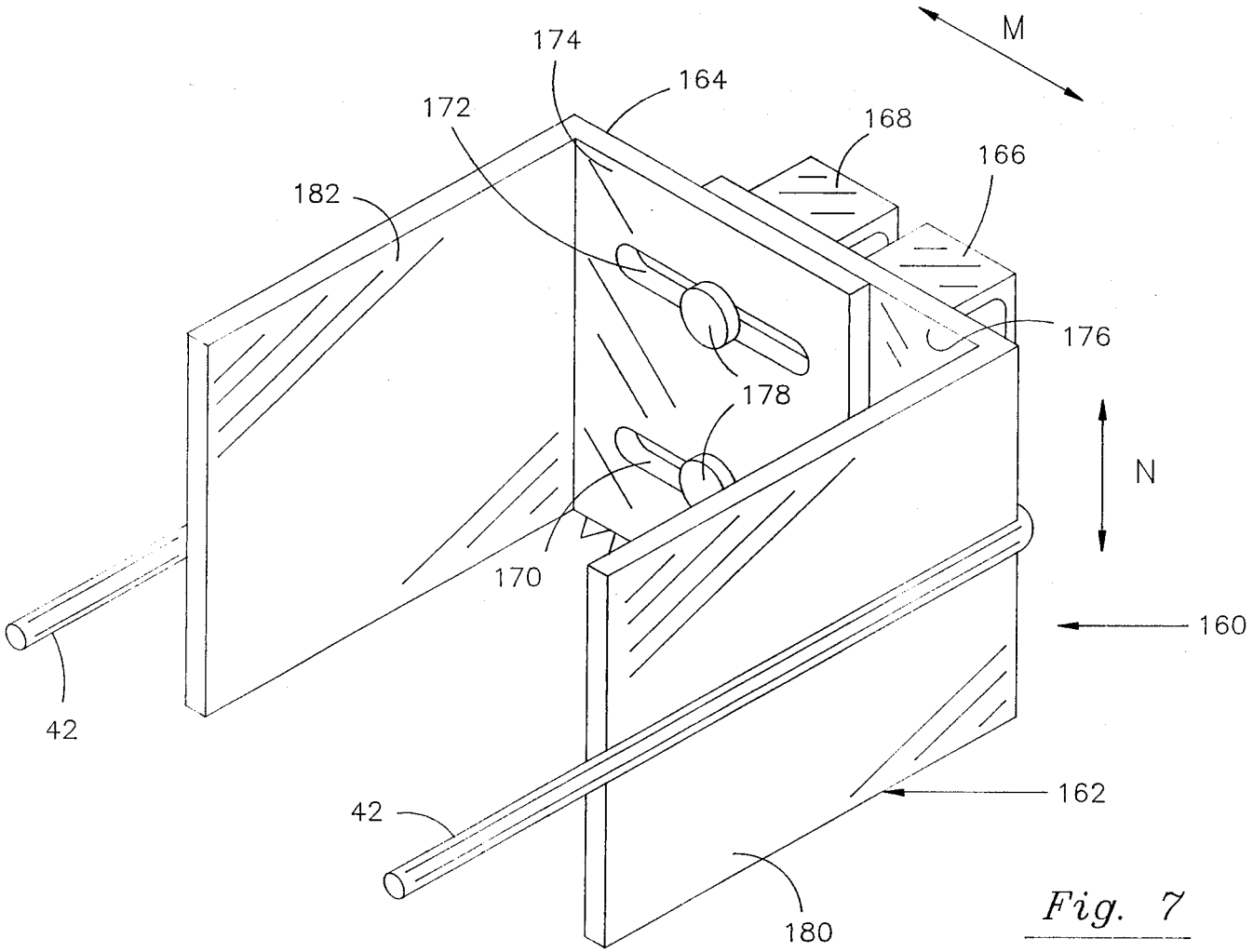
FIG. 7 is an isometric view of the tie or timber clasping apparatus portion of the invention.

A tie clasping apparatus portion of the invention designated generally 160 in FIG. 1 is illustrated isometrically in FIG. 7. Tie clasping apparatus 160 transfers tensile force in cable 42, resulting from rotation of shaft 32, to an end of a tie or timber, urging the tie or timber in the desired direction of longitudinal travel during removal from or insertion into position under the track. Tie clasping apparatus 160 can be width-adjusted to facilitate clasping ties of different sizes. Clasping apparatus 160 includes a pair of transversely slidably engaging plate members designated generally 162 and 164 in FIG. 7. Plate member 162 includes a pair of handle-like receptacle loops 166, 168, preferably formed of steel and secured to plate member 162 via welds or suitable bolts. Loops 166, 168 receive and restrain cable 42 so that tensile force in cable 42 is suitably transferred to a tie or timber clasped by apparatus 160 by cable 42 transferring force or tension to plate member 162, 164.

Plate members 162, 164 are slidably movable with respect to one another in direction M in FIG. 7. This sliding engagement is provided via generally horizontally elongated slots 170, 172 formed in a first flat surface 174 of plate member 164. Plate member 162 includes a first flat surface 176 generally corresponding to first flat surface 174 of plate 164, where first flat surfaces 174, 176 are in generally facing, complemental contact with one another and are transversely slidably engagable with respect to one another. Such transverse sliding engagement is provided via suitable rivets 178 secured to first flat surface 176 of plate 162 and protruding through slots 170, 172 respectively, with the heads of rivets 178 flattened to facilitate sliding of plate members 162, 164 and to prevent disengagement of these plate members from one another. Movement of plate members 162, 164 in the directions indicated by arrow M facilitates clasping ties or timbers of differing sizes.

Each plate member 162, 164 preferably has a second portion, designated respectively 180, 182, generally transversely disposed with respect to respective first flat surface portions 174, 176 and hence adapted for close fitting with the side of the tie or timber being removed. Flat surfaces 174, 176 abuttingly contact the end of the tie or timber to which force from cable 42 is to be applied.

As illustrated in FIG. 1, it is desirable that respective loose ends of cable 42 be equipped with hood members 184 which engage corresponding eyes 186 secured to respective looped ends 188 of a piece of heavy fabric webbing, preferably made of woven nylon. This webbing designated generally 190 may be one or two inches wide, where such width is measured in the direction indicated by arrow N in FIG. 7, and transfers tensile force from cable 42 to tie clasping apparatus 160 in a uniform manner, distributing the force over the area of flat surface potions 174, 176 of plates 162, 164.

When a tie or a timber is to be inserted under rail 18 by movement in the direction indicated by arrow R in FIG. 3, cable 42 is preferably fed off reel 40 in the direction indicated by the portion of cable 42 designated 42R, which is to the right in FIG. 3. When the tie or timber is to be moved in the direction indicated by arrow L in FIG. 3, cable 42 is fed off reel 40 and around spacers 76 in the manner indicated by the portion of cable designated as 42L in FIG. 3. When the cables are fed as indicated by portions 42R and 42L, the cable (in each case) is fed off reel 40 from above the axis of rotation of shaft 32. Alternatively, direction in which tensile force from the cable is applied to a tie may be changed by feeding the cables off reel 40 from below the axis of rotation of shaft 32 and threading the cable through spacers 76.

Ratchet plates 80 mounted on hinge pin 82 are shown in FIG. 2. Ratchet plates 80 may be moved towards one another to disengage them from ratchet gear 38. Each ratchet plate 80 is equipped with a suitable stop member 83 which can contact the upper surface of bridging member 16 to preclude movement of the ratchet plate 80 clockwise about hinge pin 82 in FIG. 3, which would otherwise result in disengagement of ratchet plate 80 from ratchet gear 38. A suitable relief or orifice 85 is provided in bridging member 16 for receipt of stop member 83. Orifice 85 receives stop member 83 when ratchet plates 80 are moved together to close the space illustrated between them in FIG. 2 and to disengage them from ratchet gear 38 by rotating ratchet plates 80 about hinge pins 82. A similar stop member 87 is provided, as part of ratchet plates 80, to preclude excessive rotation of ratchet plates 80 in a counterclockwise direction viewed in FIG. 3 by contacting bridging member 16. Consequently, ratchet plates 80 are positioned as illustrated in FIG. 2 along the axes of hinge pins 82 and in engagement with ratchet gear 38; they are retained in that position by spring means 84. Stop members 83, 87 contacting bridging member 16 define the limits of angular travel of ratchet plates 80.

Figure 8:
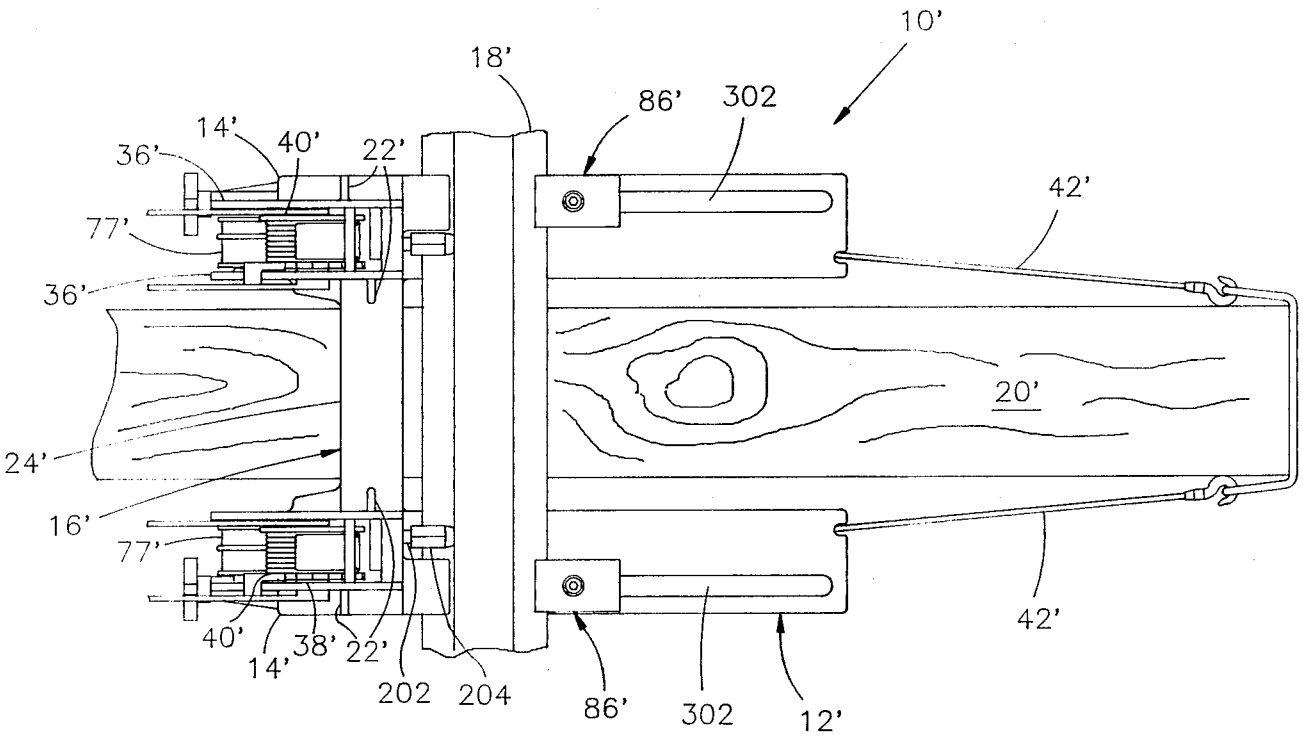
FIG. 8 is a top view of a second and preferred embodiment of apparatus, manifesting aspects of the invention, engaging a railroad track rail and applying a force to a railroad track tie under the rail.
Figure 9:
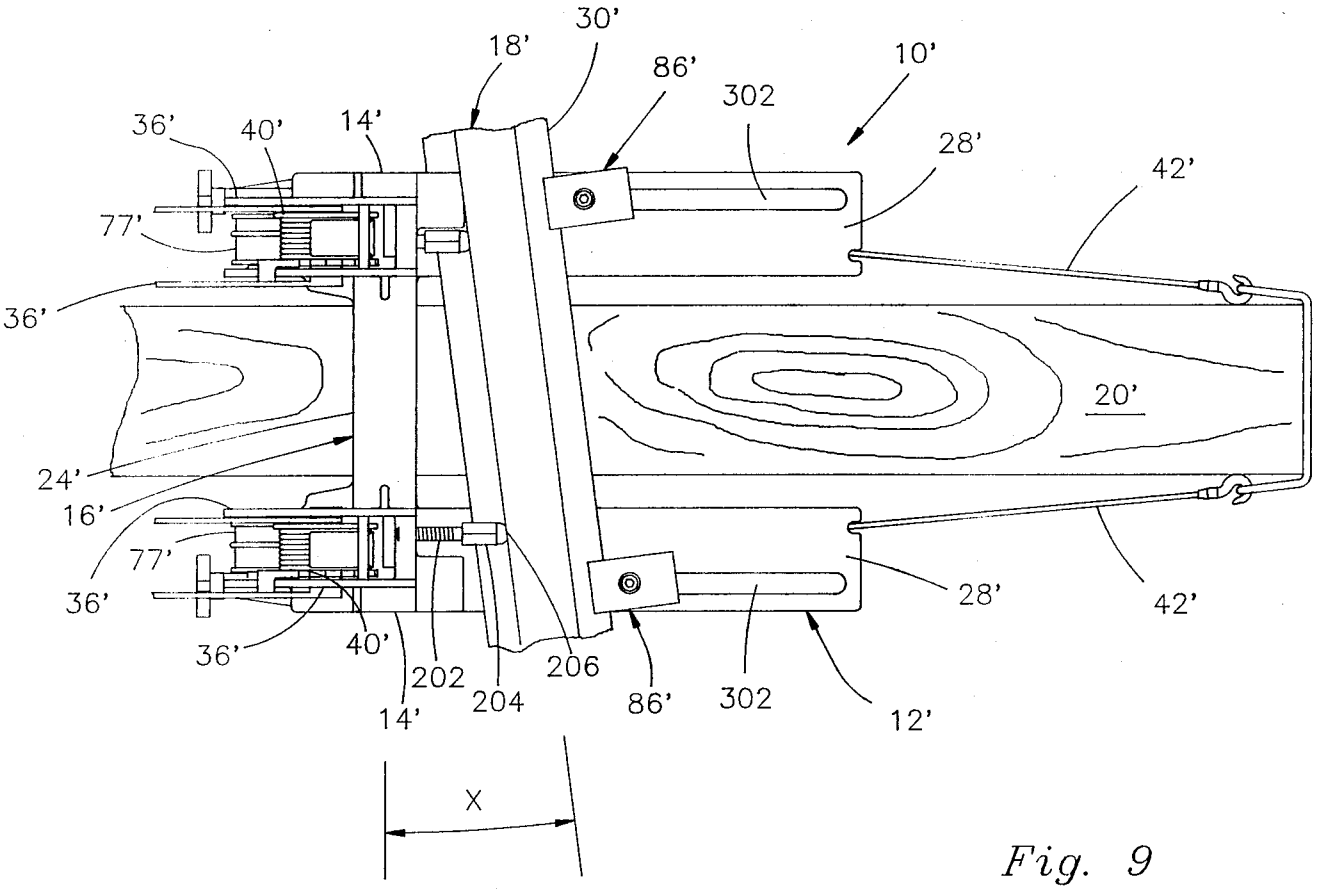
FIG. 9 is a top view of the apparatus illustrated in FIG. 8, engaging an out of square railroad track and applying force to a railroad track tie under the rail.
Figure 10:
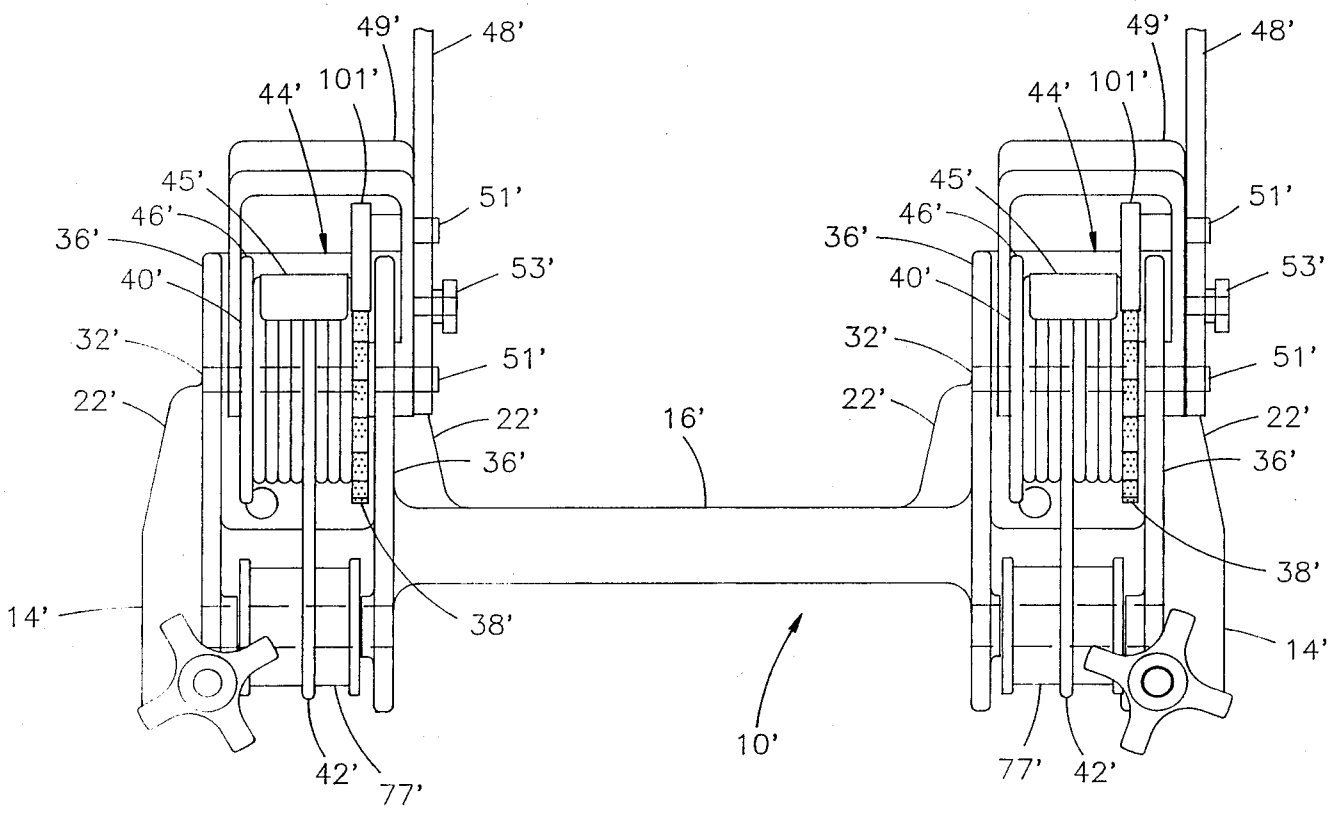
FIG. 10 is a front view, partially in section, of the apparatus illustrated in FIG. 8 with the section taken at 10—10 in FIG. 8.

Referring now to FIGS. 8, 9, 10 and 11, a second and preferred embodiment of apparatus 10′ is shown. In FIGS. 8 and 10, base 12′ includes support members 14′ and a bridging member 16′ fixedly secured to longitudinally elongated (with respect to the longituninal axis of the railroad tie of interest) support members 14′, to position support member 14′ spaced apart a distance sufficient to permit support members 14′ to be inserted, beneath a rail 18′, forming part of a conventional railroad track, in either side of a conventional tie or timber 20′ to be removed from the railbed. Reinforcing flanges or webs 22′ are provided for bracing bridging member 16′ and support members 14′ with reinforcing flanges 22′ preferably being welded to support members 14′ and bridging member 16′ or integrally cast therewith to provide additional structural rigidity.

Base 12′ may be fabricated from a single member,-such as a single casting. Also, spaced apart support members 14′ may be bolted to bridging member 16′ or secured by other means so long as adequate strength and rigidity is provided. Bridging member 16′ extends generally parallel with the railroad track rail. Once welded together or cast, base 12′, including support members 14′, bridging member 16′ and reinforcing flanges 22′, provides a strong yet lightweight base for the apparatus with bridging member 16′ being generally above support members 14′.

Support members 14′ are longitudinally elongated and positioned with their longitudinal axes transverse to the operating rail 18′, as illustrated generally in FIG. 8. However, as illustrated in FIG. 9, the apparatus may be positioned with support members 14′ having their longitudinal axes canted slightly relative to the transverse direction represented by rail 18′, when the apparatus is applied to out-of-square track, for example. X is the angle between rail 18′ and bridging member 14 of apparatus 10′ in said case.

Figure 11:
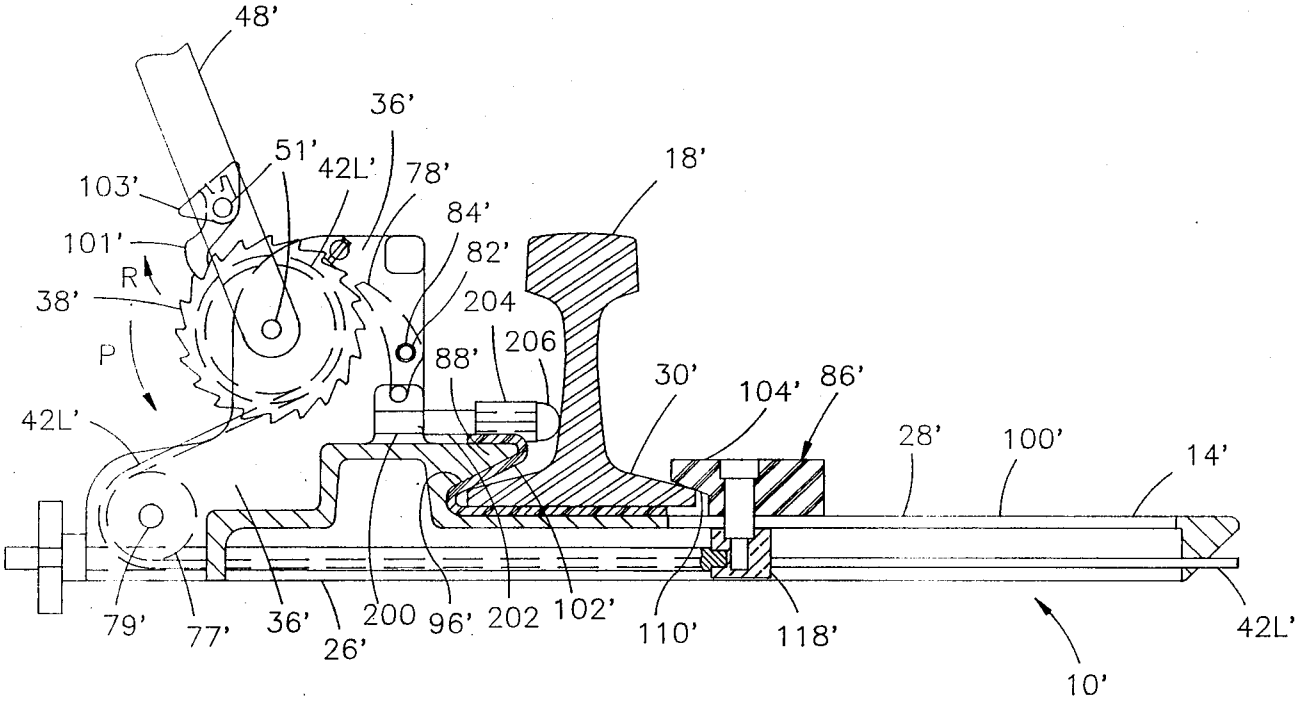
FIG. 11 is a side view, partially in section, of the apparatus illustrated in FIGS. 8 and 10 with the section taken at 11—11 in FIG. 8.

Each support member 14′ has at least a portion of its upper surface 28′ substantially flat and adapted to be positioned coplanar with the lower surface of the base 30′ of rail 18′, for flush facing contact therebetween as illustrated in FIG. 11. Upper flat surface 28′ of support member 14′ extends some distance along the longitudinal length thereof, to facilitate flush facing contact with the bases of rails of various sizes.

As shown in FIG. 10, a pair of rotatable shafts 32′ are mounted on and spaced above bridging member 16′. Shafts 32′ are journaled in bearings (not shown) housed in upstanding legs 36′ extending upwardly from base 16′. Preferably at least two legs 36′ are provided to house each shaft 32′ and to provide adequate support for shafts 32′ when load is applied thereto. Shafts 32′ may be positioned on bridging member 16′ to be generally parallel with rail 18′, when the apparatus is positioned in the railbed, and hence to be generally transverse to tie or timber 20′. However, as shown in FIG. 9, shafts 32′ may also be canted away from the transverse, if desired by the operator, when the apparatus is to be applied to out-of-square or curved track.

Mounted on each shaft 32′ for unitary rotation therewith is a gear 38′ having gear teeth cut in ratchet shape, with one side of each tooth defined by a straight line extending radially outwardly from the center of the ratchet gear and the second side of each tooth being curved like a spur gear. Each ratchet gear 38′ is positioned on its respective shaft 32′ to rotate shafts 32′ in the clockwise direction as viewed in FIG. 11.

Fixed on and rotatable with shafts 32′ are reels 4′ functioning to selectably collect or dispense a flexible line, in the form of a cable, upon rotation of shafts 32′. As shown in FIG. 10, cable 42′ resides on reel 40′ and has a first end secured to reel 40′ with a remaining end generally loose to facilitate connection to tie 20′ in order to apply tensile force thereto. Two reels 40′, each with a cable 42′, are preferably provided, equally spaced on either side of ratchet gears 38′. Each reel 40′ includes a central interior spool portion 44′ and a radially outwardly extending lip 46′ which retains the remaining portion of cable 42′ on central spool 44′ of reel 40′ as cable is drawn off of or fed on to reel 40′ by rotation of each shaft 32′. Cable retainer 45′ is positioned to ensure even spooling of cable 42′. The manner in which reels 40′ are secured to shaft 32′ is not critical so long as adequate strength is provided.

A lever assembly designated generally 48′ extends generally radially outwardly from shafts 32′ in FIGS. 10 and 11, to rotate shafts 32′ in response to angular movement of the lever with respect to the shafts, when the lever is engaged with the shafts. Lever 48′ is connected to a pair of yokes 49′, mounted to shafts 32′ and gears 38′. Pins 51′ connect to each yoke 49′ and transfer level angular movement thereto. Yokes 49′ transfer force provided by lever angular movement over both ends of shafts 32′. Without yokes 49′ lever angular movement force is localized at a single point on shaft 32′, which is undesirable. Threaded knob 53′ provided for easy removal of lever 48′.

Active pawls 101′ pivotably connect to lever 48′ and yokes 49′ via pins 51′ which are illustrated in FIGS. 10 and 11. Pawl 101′ engages a tooth of gear 38′ and upon lever angular movement of lever 48′, pawl 101′ transfers such movement to the tooth, thereby causing gear 38' to rotate in the direction indicated by arrow P. Rotation of gear 38' causes rotation of corresponding shaft 32'. Pawl 101' is spring loaded to permit reverse lever angular movement of lever 48' without continued movement or rotation of gear 38'. Latch 101', also mounted to lever 48' and yoke 49', pivots about pint 51' to allow active pawl 101' to disengage from gear 38' in the direction of arrow R. A second pawl is designated generally 78' and selectably engages each of shafts 32' for precluding rotation of shafts 32' in the direction opposite that indicated by arrow P in the FIG. 11. Second pawl 78' pivotally connects to a hinge pin 82' and is urged into position against the teeth of ratchet gear 38' by appropriate resilient spring means 84'. Pawl disengagement means (not shown) are connected to second pawl 78' to disengage pawl 78' from ratchet gear 38'. Disengagement of pawl 78' permits shaft 32' to rotate in a direction opposite to that indicated by arrow P in FIG. 11, or to "freewheel" if desired.

As best seen in FIG. 11, legs 36' not only support each of shafts 32', but provide means for mounting a reversing drum, which may be individually and independently rotatable. Preferred reversing drums are indicated as 77' in FIGS. 8, 10 and 11. These drums facilitate orderly feeding of cables 42' on to and off of reels 40' by guiding cable 42' as it is dispensed or retrieved.

Drums 77' are disposed on either side of the axes of shafts 32' as illustrated in FIG. 11 and facilitate feeding or retrieving cable 42' on to and off of reels 40' in either longitudinal direction with respect to the tie or timber being removed or inserted. Ties or timbers 20' may be fed in either longitudinal direction with the apparatus operator selecting the direction of feed by drawing cables 42' off of drums 77' from either above or below the axis of rotation of drum shafts 79'. As shown in FIG. 11, cable 42' comes off of reels 40' towards the left-hand side, and may go to the left of shafts 79' and around and underneath drums 77', and extend to the right-hand side of FIG. 11 as indicated by 42L', to urge tie or timber 20' to the left. If tie or timber 20' is to be moved in the opposite direction, tie or timber movement may be altered by positioning cable 42' to come off of drum 77' from the right side of drum shafts 79'.

As best shown in FIGS. 9 and 11, apparatus 10' has means to permit mounting to curved rails or rails that are out-of-square, for example. Bridging member 16' contains threaded holes 200 bored therein, which receive threaded rods 202. Threaded rods 202 have distal ends which are shaped in the form of hex heads 204 to facilitate longitudinal movement of rods 202 with respect to holes 200. Hex heads 204 are preferably equipped with nylon bullet ends 206 which abut rail 18'.

Mounted on support members 14' are means for releasably engaging rail 18' below the operating surface thereof and for preventing relative movement of apparatus 10' with respect to rail 18', with such means being designated generally 86' in FIGS. 8, 9 and 11. A releasable engagement means 86' is preferably provided on each of spaced apart support members 14', with each releasable engagement means 86' including a pair of jaw members mounted on a support member 14'. The jaw members include a first jaw member designated generally 88' in FIG. 11, which is fixedly secured to support member 14'. First jaw member 88' includes an angled upwardly extending angled portion 96' angled away from support member 14' to accommodate base 30' of rail 18' between angled portion 96' and support member 14'.

A flat sheet of electrically insulating material 100', preferably an elastomeric material, overlies the flat upper surface 28' of member 14' and provides an insulated flat upper surface of support member 14'. A corresponding piece of electrically insulating material 102', also preferably an elastomeric material, is secured to the lower surface of angled portion 96' so that rail 18' may be electrically insulated from apparatus 10' during removal of tie or timber 20.

Releasable engagement means 86' further includes a second jaw member 104' movable longitudinally along support member 14'. Second jaw member 104' includes angled portion 110'; similar to first jaw member 88'.

Figure 12:
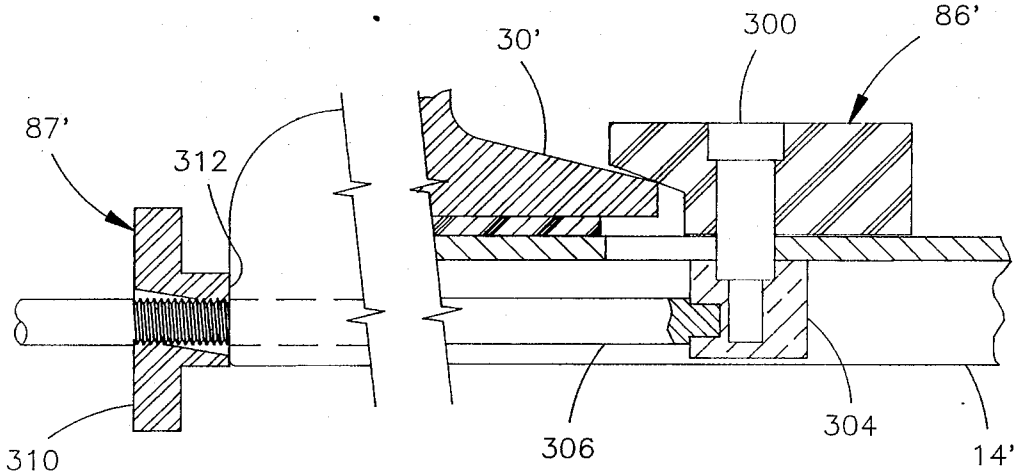
FIG. 12 is a detail, broken apart, of the extreme left-hand and middle portions of the apparatus illustrated in FIG. 11, engaging a railroad track rail.
Figure 13:
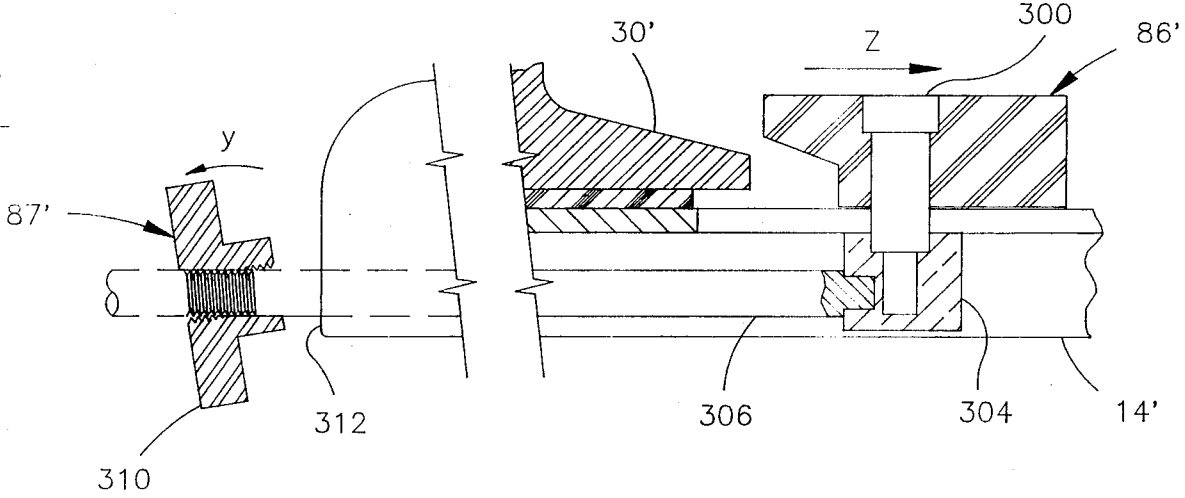
FIG. 13 is a detail, broken apart, of the apparatus illustrated in FIG. 12, disengaged from a railroad track rail.

Referring now to FIGS. 12 and 13, releasable engagement means 86' and its accompanying quick release means, designated generally 87', are shown. In FIG. 12 second jaw member 104' tightly engages rail base 30'. Shoulder bolt 300 extends through second jaw member 104' and permits member 104' to rotate about its central axis. Bolt 300 extends through slot 302 (shown in FIG. 8) in support member 14' and into jaw member lower extension 304. Slot 302 extends longitudinally along support member 14', thereby allowing longitudinal sliding movement of second jaw member 104' and jaw member lower extension 304. Threaded connector shaft 306 is fixed to jaw member lower extension 304 by connecting means, such as a connector pin for example, and extends longitudinally underneath slot 302 and along support member 14'. Quick opener knob 310, bored as illustrated in FIG. 12, threadingly engages shaft 306 and abuts frame and surface 312.

Rotation of knob 310 as it abuts frame end surface 312 causes threaded shaft 306 to move to the left in FIG. 12. Leftward movement by threaded shaft 306 causes simultaneous leftward movement of second jaw member 104'. As second jaw member moves leftward, it engages rail base 30'. Continued rotation of knob 310 causes tighter engagement of second jaw member 104' against rail base 30', thereby tightly fixing apparatus 10' against rail 18' for tie or timber removal.

Canting of knob 310 in the direction of arrow Y permits knob 310 to disengage from threaded shaft 306. Disengagement of threaded shaft 306 from knob 310 permits second jaw member 104' to quickly and easily slide along slot 302 in support member 14' in the direction of arrow Z to disengage from rail base 30'.

Typically, apparatus 10', as illustrated in FIG. 8, is mounted to straight, unbroken rails, for example. In such situations, rods 202 are evenly longitudinally set, with bullet ends 206 extending outwardly an equal distance from legs 36' . Apparatus 10' may then be applied to rail 18' such that bridging member 16' and rail 18' are essentially parallel and support members 14' and rail 18' are essentially perpendicular.

In FIG. 9, apparatus 10' has been mounted to a rail 18' which is out-of-square with tie 20'. Bridging member 16' and rail 18' are no longer essentially parallel and support members 14' and rail 18' are no longer essentially perpendicular. X depicts the distance rail 18' and apparatus 10' are out-of-square. To obtain a tight fit of apparatus 10' on rail 18', one of hex heads 204 is rotated, with a wrench for example, which rotates threaded rod 202 within threaded hole 200. Such rotation causes bullet end 206 to move longitudinally to forcibly about rail 18'.

I claim the following:

1. Apparatus for replacing railroad ties by removing a first railroad tie from position under conventional railroad tracks by moving said first tie transversely to said track and inserting a second, replacement tie into the vacant tie position by moving said second replacement tie in a direction opposite to the direction to removal of said first tie, while permitting train passage over said track while said apparatus is in place for said first tie removal and said second tie insertion, comprising:

a. a pair of longitudinally elongated spaced apart support members adapted to be inserted between a conventional railroad track rail and ballast beneath said rail, transversely with respect to said rail, on either side of said first tie to be removed from under said rail and on either side of space vacated by said first tie into which said second tie is to be inserted beneath said rail, portions of upper surfaces of said support members being substantially flat and adapted to be positioned coplanar with the lower surface of the base of said rail for flush facing contact therewith;

b. a bridging member secured to said support members, fixedly positioning said support members spaced apart with respect to each other sufficiently to permit said support members to be inserted beneath said rail on either side of said tie to be removed;

c. transversely positioned shaft means rotatably mounted on and spaced above said bridging member;

d. reel means fixedly connected to and rotatable with said shaft, for selectably collecting and dispensing flexible line means in either longitudinal direction with respect to said tie upon shaft rotation in a single direction;

e. said flexible line means residing on said reel means, having a first end secured to said reel means and having a remaining end loose and providing means for converting rotation of said reel means in said single direction to tensile force applied along said longitudinal direction of said line means;

f. means mounted on said support members, for releasably engaging said rail below the operating surface thereof and preventing relative movement of said apparatus with respect to said rail;

g. lever means extending radially outwardly from said shaft, for rotating said shaft in response to angular movement of said lever with respect to said shaft upon said lever being connected with said shaft;

h. first ratchet means for selectably connecting said lever with said shaft for rotation of said shaft in a first rotational direction upon lever angular movement in a first angular direction with respect to said shaft and for lever angular movement in a second angular direction, opposite said first angular direction, without shaft rotation resulting;

i. second ratchet means, selectably engaging said shaft, for precluding shaft rotation in other than said first rotational direction;

j. means for selectably engaging said first ratchet means with said shaft;

k. means for selectably engaging said second ratchet means with said shaft; said shaft being freewheeling when said respective selectable ratchet engagement means are disengaged; and l. means for transferring tensile force in said line means to an end of either said first or said second tie in the direction of longitudinal travel thereof during respective removal from or insertion into position under said railroad track, including means for adjustably facilitating clasping of said force transferring means about ties of different sizes.

2. Apparatus of claim 1 wherein said clasping means includes transversely slidably engaging plate members and receptacle means for receiving loose ends of said line means, sliding of said plate members while engaging one another varying size of said clasping means for transferring force to ties of different sizes.

3. Apparatus of claim 2 wherein each of said plate members has a first flat surface in generally facing complemental contact with a corresponding flat surface of the remaining plate member with said flat surfaces being transversely slideably engageable with respect to one another, and has a second portion generally transversely disposed to said first flat surface and adapted for close fitting with the side of said tie, said flat surfaces abuttingly contacting an end of said tie to which said force from said line means is to be applied.

4. Apparatus of claim 1 wherein said means for releasably engaging said rail further comprises:

a. pairs of jaw members mounted on said respective support members, each pair of jaws being adapted to securely grip said rail and including a first jaw member fixed to a respective support members, and a second jaw member movably positionable along said support member; and b. means for releasably securing said movable second jaw member at a selected position along said support member at which said rail is securely gripped between said respective pair of jaw members.

5. Apparatus of claim 4, wherein said support members have shaped surfaces, wherein said movable second jaw members have surfaces adapted for complemental contact with said shaped surface of said respective support members, wherein said second jaw members are movable along said respective support members towards and away from said rail when said securing means is released.

6. Apparatus of claim 5 wherein said releasable securing means comprises:

a. first rack members secured to said respective support members;

b. said second jaw members including second rack members longitudinally movable with respect to and adapted for fixed meshing engagement with said first rack members at a plurality of longitudinal positions with respect thereto.

7. Apparatus of claim 6 wherein said second jaw members include means for urging said second rack member into meshing engagement with said first rack member and thereafter retaining said respective rack members in tight meshing engagement.

8. Apparatus of claim 7 wherein said urging means includes a camming surface and follower means movable therealong for translating motion applied to said follower means into force of increasing magnitude applied to said second rack member in a direction urging said first and second rack members into tight engagement.

9. Apparatus of claim 3 wherein said means for releasably engaging said rail further comprises:

a. pairs of jaw members mounted on said respective support members, each pair of jaws being adapted to securely grip said rail and including a first jaw member fixed to a respective support member and a second jaw member movably positionable along said support member; and b. means for releasably securing said movable second jaw member at a selected position along said support member at which said rail is securely gripped between said pair of jaw members mounted on said respective support member.

10. Apparatus of claim 9 wherein said support members have shaped surfaces at extremities thereof remote from said bridging member, wherein said movable second jaw members have shaped surfaces adapted for complemental facing contact with said shaped surfaces of said respective support members, wherein said second jaw members are movable along said respective support members towards and away from said rail when said securing means is released.

11. Apparatus of claim 10 wherein said releasable securing means comprises:

a. a first longitudinally elongated rack member extending along and secured to said respective support members and facing generally oppositely from said shaped surface portion thereof;

b. said second jaw members including second rack members longitudinally movable with respect to and adapted for fixed meshing engagement with said first rack members at a plurality of positions along the longitudinal length thereof;

c. means for connecting said second rack members with respective second jaw members for longitudinal movement of those connected members along said support members below said shaped surfaces thereof.

12. Apparatus of claim 11 wherein said means for connecting said respective second rack members with said respective second jaw members includes means for urging said second rack members perpendicularly towards first rack members until meshing engagement of said rack members results and for thereafter retaining said respective rack members in tight meshing engagement with each other.

13. Apparatus of claim 12 wherein said urging means includes a camming surface and follower means movable therealong for translating rotary motion applied to said follower means into force of increasing magnitude applied to said second rack means in a perpendicular direction urging said first and second rack members into tight engagement as said followers means follows said camming surface in response to said rotary motion applied thereof.

14. Apparatus for removing a railroad tie transversely from under conventional railroad tracks and inserting a replacement tie into the vacated tie position oppositely to the removal direction, comprising:

a. a base member insertable below a conventional railroad track rail on either side of said tie to be removed, said base having a substantially flat upper surface portion adapted for flush facing contact with the lower surface of the base of said rail;

b. transversely positioned shaft means rotatably mounted on said base member and spaced thereabove;

c. flexible tensile force transmission means residing on said shaft means, having a first end secured to said shaft means and having the remaining end loose, for converting rotation of said shaft means to tensile force along a direction of extension of said flexible force transmission means; wherein said flexible force transmission means may be extended in either direction longitudinally with respect to said tie from said shaft to transmit force in either of said longitudinal direction as said shaft rotates in a single direction;

d. means connected to said base member for releasably engaging said rail below the operating surface thereof and preventing relative movement of said base member with respect to said rail at least in part by urging said flat upper surface portion of said base member into flush facing contact with the base of said rail;

e. lever means for rotating said shaft in response to angular movement of said lever means when said lever is connected with said shaft;

f. means for connecting said lever means with said shaft for shaft rotation in a first direction upon lever movement in a first angular direction and for allowing lever movement in an opposite angular direction without shaft rotation; and g. means for transferring force in said flexible tensile force transmission means to an end of one of said ties in the direction of longitudinal movement thereof during removal from or insertion into position beneath said railroad track, said force transferral means including means for adjustably transferring force in said flexible tensile force transmission means to ties of different widths.

15. Apparatus of claim 14 wherein said means for releasably engaging said rail further comprises:

a. means mounted on said base, for securely gripping said rail, including at least one jaw member movably positionable along said base to a position at which said rail is securely gripped between said movable jaw member and a second portion of said gripping means; and b. means for releasably securing said movable jaw member at a selected position on said base at which said rail is securely gripped between said jaw member and said second portion of said gripping means.

16. Apparatus of claim 15 wherein said base has a shaped surface, wherein said movable jaw member has a surface adapted for complemental contact with said shaped surface of said base, wherein said jaw member is movable along said base towards and away from said rail on said shaped surface when said releasable securing means is released.

17. Apparatus of claim 16 wherein said means for releasably engaging said rail comprises:

a. a first rack member secured to said base member;

b. said movable jaw member including a second rack member movable with respect to and adapted for fixed meshing engagement with said first rack member at a plurality of longitudinal positions with respect thereto.

18. Apparatus of claim 17 wherein said jaw member includes means for urging said second rack member into meshing engagement with said first rack member and thereafter retaining said respective rack members in tight meshing engagement.

19. Apparatus of claim 18 wherein said urging means includes a camming surface and follower means movable therealong for translating motion applied to said follower means into force applied to said second rack means in a direction urging said first and second rack members into tight engagement.

20. In apparatus for removing a railroad tie transversely from under conventional railroad tracks and inserting a replacement tie into the vacated tie position including a base; transversely positioned shaft means rotatably mounted on said base member and spaced thereabove; flexible tensile force transmission means residing on said shaft means, having a first end secured to said shaft means and having the remaining end loose, for converting rotation of said shaft means to tensile force along a direction of extension of said flexible force transmission means; means connected to said base member for abutting said rail below the operating surface thereof and preventing movement of said base towards said rail; lever means for rotating said shaft in response to angular movement of said lever means when said lever is connected with said shaft; means for connecting said lever means with said shaft for shaft rotation in a first direction upon lever movement in a first angular direction and for allowing lever movement in an opposite angular direction without shaft rotation and means for transferring force in said flexible tensile force transmission means to an end of one of said ties in the direction of longitudinal movement thereof during removal from or insertion into position beneath said railroad track, the improvement comprising:

a. said base being insertable below a conventional railroad track on either side of said tie to be removed and having an upper surface portion adapted for flush facing contact with the lower surface of the base of said rail;

b. means connected to said base for releasably engaging said rail below the operating surface thereof and preventing relative movement of said base with respect to said rail by urging said upper surface portion of said base into flush facing contact with the lower surface of the base of said rail, comprising:

i. jaw means mounted on said base, for gripping said rail and including a first jaw member fixed to said base and a second jaw member movable along said base;

ii. means for releasably securing said second jaw member at a selected position along said base at which said rail is securely gripped by said jaw means;

iii. said base having a shaped surface; wherein said second jaw member has a surface adapted for complemental contact with said shaped surface of said base, said second jaw member being movable along said base shaped surface away from said rail when said releasable securing means is released;

iv. a first rack member secured to said base;

v. said second jaw member including a second rack member longitudinally movable with respect to and adapted for fixed meshing engagement with said first rack member at a plurality of longitudinal positions with respect thereto; and vi. means for urging said second rack member into meshing engagement with said first rack member and thereafter retaining said respective rack members in tight meshing engagement.

21. Apparatus for replacing railroad ties by moving a first railroad tie from position under conventional railroad tracks and inserting a second, replacement tie into the vacant tie position by moving said second replacement tie in a direction opposite to the direction of removal of said first tie, while permitting train passage over said track while said apparatus is in place for said first tie removal and said second tie insertion, comprising:

a. a pair of longitudinally elongated spaced apart support members adapted to be inserted between a conventional railroad track rail and ballast beneath said rail on either side of said first tie to be removed from under said rail and on either side of space vacated by said first tie into which said second tie is to be inserted beneath said rail, portions of upper surfaces of said support members being substantially flat and adapted to be positioned coplanar with the lower surface of the base of said rail for flush facing contact therewith;

b. a bridging member secured to said support members, fixedly positioning said support members spaced apart with respect to each other sufficiently to permit said support members to be inserted beneath said rail on either side of said tie to be removed;

c. shaft means transversely positioned with respect to said bridging member and rotatably mounted on and spaced thereabove;

d. reel means fixedly connected to and rotatable with said shaft means, for selectably collecting and dispensing flexible line means in either longitudinal direction with respect to said tie upon shaft rotation in a single direction;

e. said flexible line means residing on said reel means, having a first end secured to said reel means and having a remaining end loose and providing means for converting rotation of said reel means in said single direction to tensile force applied along said longitudinal direction of said line means;

f. first means mounted on said support members, for releasably engaging said rail below the operating surface thereof and preventing relative movement of said apparatus with respect to said rail;

g. second means mounted on said bridge member for releasably engaging said rail on the side opposite said first releasably engaging means and preventing relative movement of said base member with respect to said rail;

h. lever means extending radially outwardly from said shaft, for rotating said shaft means in response to angular movement of said lever means with respect to said shaft means upon said lever means being connected with said shaft means;

i. means for selectably connecting said lever means with said shaft means for rotation of said shaft means in a first rotational direction upon lever angular movement in a first angular direction with respect to said shaft means and for lever angular movement in a second angular direction, opposite said first angular direction, without shaft means rotation resulting;

j. means selectably engaging said shaft means for precluding shaft means rotation in other than said first rotational direction;

k. means for transferring tensile force in said line means to an end of either said first or said second tie in the direction of longitudinal travel thereof during respective removal from or insertion into position under said railroad track, including means for adjustably facilitating clasping of said force transferring means about ties of different sizes.

22. Apparatus of claim 21 wherein said clasping means includes transversely slidably engaging plate members and receptacle means for receiving loose ends of said line means, sliding of said plate members while engaging one another varying size of said clasping means for transferring force to ties of different sizes.

23. Apparatus of claim 22 wherein each of said plate members has a first flat surface in generally facing complemental contact with a corresponding flat surface of the remaining plate member with said flat surfaces being transversely slidably engageable with respect to one another, and has a second portion generally transversely disposed to said first flat surface and adapted for close fitting with the side of said tie, said flat surfaces abuttingly contacting an end of said tie to which said force from said line means is to be applied.

24. Apparatus of claim 21 wherein said first means for releasably engaging said rail further comprises:

a. pairs of jaw members mounted on said respective support members, each pair of jaws being adapted to securely grip said rail and including a first jaw member fixed to a respective support member, and a second jaw member movably positionable along said support member; and b. means for releasably securing said movable second jaw member at a selected position along said support member at which said rail is securely gripped between said respective pair of jaw members.

25. Apparatus of claim 24, wherein said support members have shaped surfaces, wherein said movable second jaw members have surfaces adapted for complemental contact with said shaped surface of said respective support members, wherein said second jaw members are movable along said respective support members towards and away from said rail when said first securing means is released.

26. Apparatus of claim 24 wherein said second means for releasably engaging said rail further comprises:

a. a plurality of clamp members mounted on said bridge member, each clamp member being adapted to securely grip said rail in combination with one of said second jaw members, said clamp members movably positionable away from said bridging member; and b. means for releasably securing said movable clamp members at selected positions away from said bridging member at which said rail is securely gripped between said clamp members and said second jaw members.

27. Apparatus of claim 26 wherein said second releasable securing means comprises:

a. elongated shaft means extending along said respective support members and connected to said second jaw members; and b. knob means threadingly engaging said elongated shaft means and adapted to rotate along said elongated shaft means, and to abuttingly engage said respective support members, thereby actuating longitudinal movement of said elongated shaft means and said second jaw members.

28. Apparatus of claim 27 wherein said knob means has a threaded central bore extending therethrough, one end of said bore having an upper portion angled away from the axis of said bore and the other end of said bore having a lower portion angled away from the axis of said bore, said upper and lower portions being free of threads so that said knob may be canted in a manner to engage said unthreaded upper and lower portions with said elongated shaft means for non-rotatable release of said knob from said elongated shaft means.

29. Apparatus of claim 26 wherein said second releasable securing means further comprises a second jaw member lower extension connected between said second jaw member and said elongated shaft means.

30. Apparatus of claim 26, wherein said clamp member comprises adjustably elongated arm means extending transversely from said bridging member.

31. Apparatus of claim 30 wherein said arm means comprises:

a. a rod extending outwardly from a threaded hole in said bridging member, and b. a hex head fixed to the distal end of said rod, said hex head having a bullet shaped end to engage a railroad track rail upon rotation of said hex head and said rod.

32. Apparatus of claim 31 wherein said bullet shaped end comprises nylon.

33. Apparatus of claim 21 wherein said shaft means comprises separate shafts mounted over said respective support members and having separate reel means fixed thereto for collecting and dispensing separate flexible line means.

34. Apparatus for removing a railroad tie from under conventional railroad tracks and inserting a replacement tie into the vacated tie position oppositely to the removal direction, comprising:

a. a base member insertable below a conventional railroad track rail on either side of said tie to be removed, said base having a substantially flat upper surface portion adapted for flush facing contact with the lower surface of the base of said rail;

b. shaft means transversely positioned and rotatably mounted on said base member and spaced thereabove;

c. flexible tensile force transmission means residing on said shaft means, having a first end secured to said shaft means and having the remaining end loose, for converting rotation of said shaft means to tensile force along a direction of extension of said flexible force transmission means; wherein said flexible force transmission means may be extended in either direction longitudinally with respect to said tie from said shaft means to transmit force in either of said longitudinal directions as said shaft means rotate in a single direction;

d. first means connected to said base member for releasably engaging said rail below the operating surface thereof and preventing relative movement of said base member with respect to said rail;

e. second means connected to said base member for releasably engaging said rail on the side opposite said first releasably engaging means and preventing relative movement of said base member with respect to said rail;

f. lever means for rotating said shaft means in response to angular movement of said lever means when said lever means is connected with said shaft means;

g. means for connecting said lever means with said shaft means for shaft means rotation in a first direction upon lever movement in a first annular direction and for allowing lever means movement in an opposite angular direction without shaft means rotation; and h. means for transferring force in said flexible tensile force transmission means to an end of one of said ties in the direction of longitudinal movement thereof during removal from or insertion into position beneath said railroad track, said force transferral means including means of adjustably transferring force in said flexible tensile force transmission means to ties of different widths.

35. Apparatus of claim 34 wherein said first means for releasably engaging said rail further comprises:

a. means mounted on said base, for securely gripping said rail, including at least one jaw member movably positionable along said base to a position at which said rail is securely gripped between said movable jaw member and a second portion of said gripping means; and b. means for releasably securing said movable jaw member at a selected position on said base at which said rail is securely gripped between said jaw member and said second portion of said gripping means.

36. Apparatus of claim 35, wherein said base has a shaped surface, wherein said movable jaw member has surface adapted for complemental contact with said shaped surface of said base, wherein said jaw member is movable along said base towards and away from said rail on said shaped surface when said releasable securing means is released.

37. Apparatus of claim 34 wherein said second means for releasably engaging said rail further comprises:

a. a plurality of clamp members mounted on said base member, each clamp member being adapted to securely grip said rail in combination with one of said second jaw members, said clamp members movably positionable with respect to said base member; and b. means for releasably securing said movable clamp members at selected positions along said base member at which said rail is securely gripped between said clamp members and said second jaw members.

38. Apparatus of claim 37 wherein said second releasable securing means comprises:

a. elongated shaft means extending along said base member and connected to said second jaw members; and b. knob means threadingly engaging said elongated shaft means and adapted to rotate along said elongated shaft means and to abuttingly engage said base support member, thereby actuating longitudinal movement of said elongated shafts means and said second jaw members.

39. Apparatus of claim 38 wherein said knob means has a threaded central bore extending therethrough, one end of said bore having an upper portion angled away from the axis of said bore and the other end of said bore having a lower portion angled away from the axis of said bore, said upper and lower portions being free of threads so that said knob may be canted in a manner to engage said unthreaded upper and lower portions with said elongated shaft means for non-rotatable release of said knob from said elongated shaft means.

40. Apparatus of claim 37 wherein said second releasable securing means further comprises a second jaw member lower extension connected between said second jaw member and said elongated shaft means.

41. Apparatus of claim 40, wherein said clamp member comprises adjustably elongated arm means extending from said base member.

* * * * *